United States Patent [19]

Mumford

[11] 4,331,247

[45] May 25, 1982

[54] ONE PIECE CHILD-RESISTANT CLOSURE

[75] Inventor: George V. Mumford, Toledo, Ohio

[73] Assignee: Owens-Illinois, Inc., Toledo, Ohio

[21] Appl. No.: 187,299

[22] Filed: Sep. 15, 1980

[51] Int. Cl.[3] ..... B65D 55/02; B65D 85/56

[52] U.S. Cl. ..... 215/216

[58] Field of Search ..... 215/216, 221, 206, 217, 215/330

[56] References Cited

U.S. PATENT DOCUMENTS

| | | | |
|---|---|---|---|
| 3,830,391 | 0/0000 | Uhlig | 215/216 |
| 3,877,597 | 4/1975 | Montgomery et al. | 215/216 X |
| 3,984,021 | 10/1976 | Uhlig | 215/216 |
| 4,106,651 | 8/1978 | Lemons | 215/221 |
| 4,116,351 | 9/1978 | Uhlig | 215/216 |

FOREIGN PATENT DOCUMENTS

| | | | |
|---|---|---|---|
| 1179296 | 4/1967 | United Kingdom | 215/216 |

*Primary Examiner*—George T. Hall

*Attorney, Agent, or Firm*—John R. Nelson; Myron E. Click; David H. Wilson

[57] ABSTRACT

A child-resistant container and closure combination includes a one piece molded closure threadable on a container neck. When the closure is fully threaded onto the container neck, a pawl, integrally formed on the bottom of the closure skirt, interlocks with a lug projecting from the container neck to prevent rotational removal of the closure. One end of the pawl is integrally attached to the closure by a relatively thin and flexible bridge, and a slot is formed in the closure skirt immediately above the pawl and bridge. The flexibility provided by the slot and the thin bridge attachment permits the pawl to be manually deflected upwardly to disengage the pawl and lug, thereby permitting rotational removal of the closure.

3 Claims, 4 Drawing Figures

ONE PIECE CHILD-RESISTANT CLOSURE

BACKGROUND OF THE INVENTION

Many types of child-resistant closures are known in the prior art. In general, such closures require some purposeful manipulation, which is beyond the ability of a child, before the closure may be removed from the container. Two piece child-resistant closures are common. Typically, these include a threaded closure surrounded by an outer shell. The shell rotates freely relative to the threaded inner closure unless it is manipulated in a particular manner.

However, in many applications, for the sake of economy and simplicity, a one piece child-resistant closure is desired. A one piece child-resistant closure must operate in combination with a container having a specially designed neck or finish. In general, such combination have at least a pair of interlocking members, one on the closure and one on the container. When the interlocking members are interengaged, rotation of the closure relative to the container is prevented. At least one of the interlocking members is flexible, thereby permitting the interlocking members to be manually disengaged.

The following United States Patents are representive of prior art one piece child-resistant closures:

| | |
|---|---|
| 3830391 | Uhlig |
| 3877597 | Montgomery et al. |
| 3894647 | Montgomery |
| 4103797 | Morris |

All of the above closures have undesirable features which adversely affect the reliability, the cost, or the versatility of the closure design.

The Uhlig patent discloses several embodiments, the most relevant of which are illustrated in FIGS. 1 through 7. The Uhlig closure has an upwardly deflectable tab on the closure engagable with a projection formed on the container neck. To assure the necessary flexibility, the tab is integrally formed on the periphery of a radially extending flange at the bottom of the closure skirt. Such a design requires a relatively large amount of material to form the flange, and requires a relatively large cooperating shoulder on the container neck.

The patents to Montgomery et al. disclose closures having a locking tab radially projecting from the bottom edge of the skirt. The tab is upwardly deflectable by manipulation. The skirt of the closure is also relatively flexible, to permit an upward deflection of the tab without undue stress at its juncture with the skirt.

The Patent to Morris discloses a container neck having a pawl mounted on a beam. The beam is axially deflectable and is integrally attached to the container wall by thin, flexible radial bars. These bars are relatively weak points in the structure of the child-resistant container.

An improved one piece child-resistant closure would reduce the amount of material necessary to manufacture the closure, would have a reliable yet flexible integral attachment of a locking member to the closure skirt, would minimize the necessary diameter of th closure skirt, and would permit greater latitude in container shoulder design.

SUMMARY OF THE INVENTION

The invention provides a one piece child-resistant closure to cooperate with a container neck having an upwardly projecting locking lug formed on a head or shoulder on the container neck. The closure has a generally circular top panel section, and an integral, annular skirt depending from the periphery of the panel. The internal surface of the skirt is threaded to engage corresponding threads on the container neck. A pawl integrally formed on the lower edge of the skirt is upwardly deflectable past the locking lug when the closure is rotated in the direction to apply the closure. When the closure is fully threaded onto the neck, the axial pawl face, or detent surface, abuts the locking lug to prevent rotational removal of the closure.

The pawl is formed as a downwardly and outwardly thickened extension of the lower skirt edge. Above the pawl a circumferentially extending slot is formed in the skirt wall. The slot extends beyond the detent surface of the pawl. At the end of the pawl opposite of the detent surface, the pawl is integrally attached to the skirt by a relatively thick portion. The end of the pawl terminating in the detent surface is integrally attached to the skirt only by a relatively thin skirt segment defined between th slot and the lower skirt edge.

To remove the closure, the pawl must be manually deflected upwardly, thereby disengaging it from the locking lug formed on the container neck. The slot in the skirt provides the flexibility necessary to permit this deflection.

DESCRIPTION OF THE PREFERRED EMBODIMENT

Figure 1:
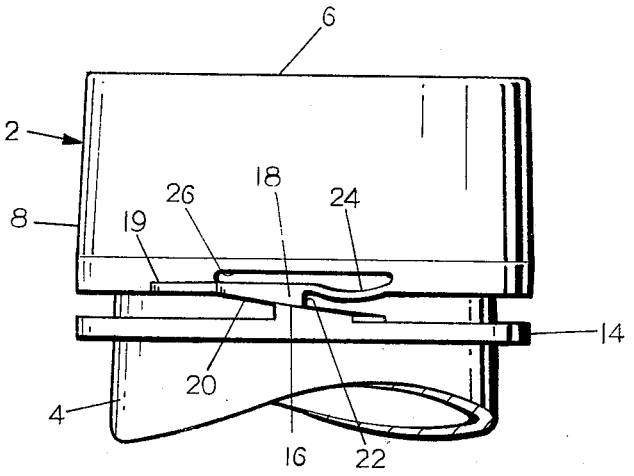
FIG. 1 is a side elevational view of a one piece child-resistant closure and a cooperating container finish, illustrating the deflection of the locking pawl as it passes the locking lug.
Figure 2:
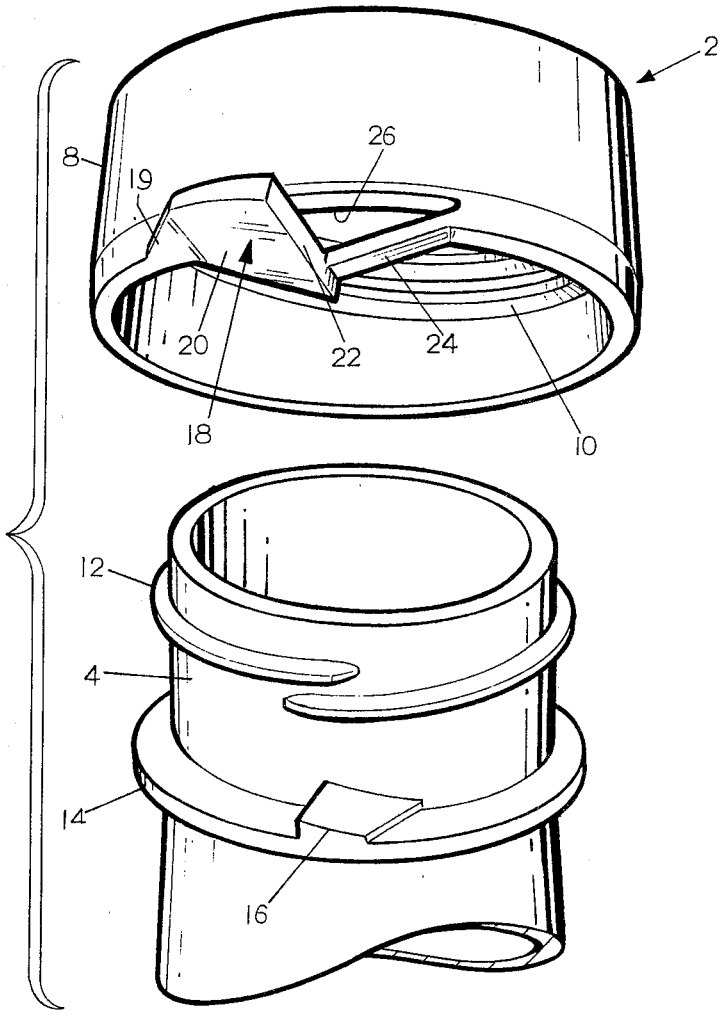
FIG. 2 is an exploded perspective view of the container and closure combination of FIG. 1.
Figure 3:
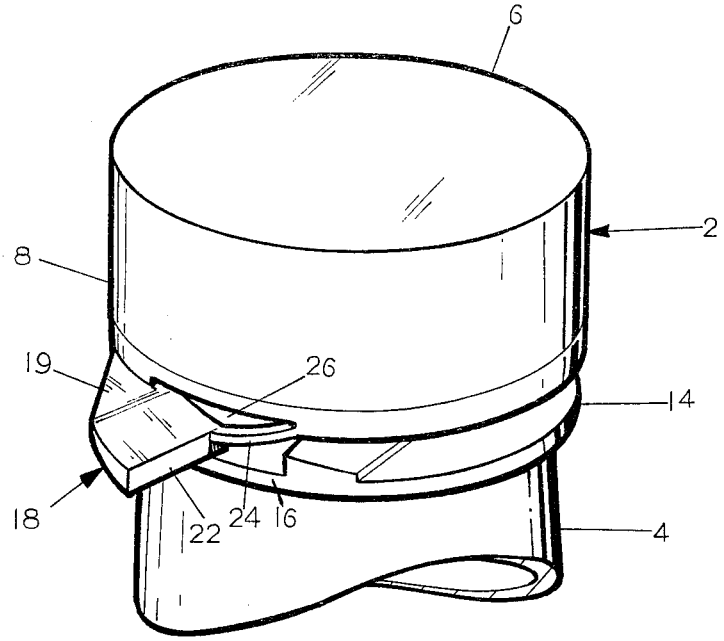
FIG. 3 is a perspective view illustrating the closure fully threadably engaged on the container finish.
Figure 4:
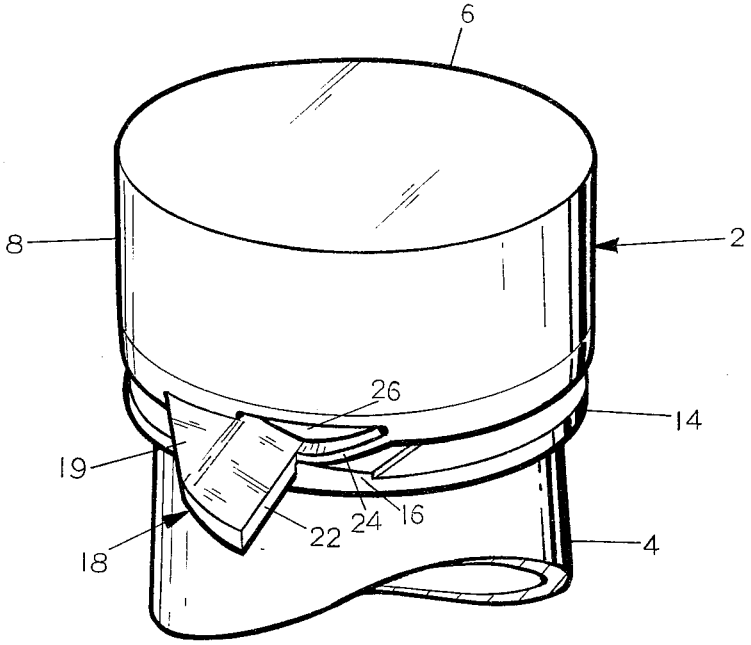
FIG. 4 is a perspective view of the closure and container of FIG. 1, illustrating the interference between the pawl and lugs as the closure is rotated in the removal direction.

As illustrated in the drawing, a child-resistant closure 2 is designed to be threadably applied to a container neck 4, and releasably locked thereon. The closure 2 comprises a top, disc shaped panel 6, and an annular skirt 8 depending from the periphery of the panel 6 and is molded from a resilient plastic material. On the inside cylindrical surface of the skirt 8, threads 10 are formed, which are engagable with corresponding threads 12 formed on the neck 4. Below the container threads 12, an annular bead 14 is formed. An integral lug 16 projects upwardly from the upper surface of the bead 14. When the closure 2 is fully threadably engaged with the neck 4, the lower edge of the skirt 8 lies adjacent to the bead 14. The lug 16 interferes with a locking pawl 18 formed on the lower edge of the closure skirt 8. Rotational removal of the closure 2 from the container neck 4 is thereby prevented, unless the locking pawl 18 is manually deflected.

The pawl 18 is integrally formed on the closure skirt 8 in a configuration which minimizes the amount of material needed to form the closure, and minimizes the diameter of the closure 2. The configuration is such that the pawl 18 is securely attached to the closure 2, yet readily deflectable. The pawl 18 is integrally formed as a radial extension of the lower edge of the skirt 8. One circumferential end 19 of the pawl 18 tapers radially inwardly to the periphery of the skirt 8. The lower surface 20 of the pawl 18 tapers downwardly, thereby forming a camming surface. The rearward edge of the pawl 18 terminates in an axial pawl face, or detent surface 22. Attaching this end of the pawl 18 to the skirt 8 is a relatively thick flexible bridge 24, extending from the detent surface 22 to the main body of the skirt.

Above the pawl 18 and bridge 24, a circumferentially extending slot 26 is formed through a segment of the skirt 8. The slot 26 therefore defines the upper surfaces of the pawl 18 and bridge 24.

As the closure 2 is threaded onto the container neck 4, the camming surface 20 of pawl 18 contacts the lug 16. As the closure 2 continues to be rotated, the pawl 18 is cammed up and over the lug 16 on the lower inclined surface 20 of the pawl 18. The upward camming of the pawl 18 is facilitated by the flexibility provided by the slot 26. As it passes the lug 16 the resilient pawl 18 snaps back downwardly toward its original position. Therefore, reverse rotation in the removal direction is prevented by engagment of the lug 16 and the pawl face or detent surface 22.

As the pawl 18 cams past the lug 16, it pivots upwardly approximately as if it were hinged on a radial line passing through the end of the slot 26 adjacent to the leading edge of pawl 18. However, the pawl 18 flexes somewhat throughout its circumferential length. However, the thickened radial extension forming the pawl 18 extends circumferentially beyond this end of the slot 26, tapering back towards the outer surface of the skirt 8 as shown at 19. Therefore, there is no weak stress point as the pawl 18 pivots. In contrast, a relatively weaker stress point does exist in a closure comprising a locking tab extending radially outward from the bottom edge of the skirt, which pivots upwardly as if hinged on a chord line.

The relative position of the threads 10 and 12, the lug 16, and the pawl 18 should be designed so that the closure 2 is fully threaded onto the neck 4, in liquid sealing relationship, just after the pawl 18 has snapped downwardly beyond the lug 16. A resiliently compressible sealing inner (not shown) on the inside of the panel 6 will compensate for some manufacturing tolerances in the formation of the closure 2 and the container neck 4.

To remove the closure 2, the pawl 18 is simply manually pushed upward, until the detent surface 22 no longer interferes with he lug 16. The closure 2 may then be removed by rotation.

It should be noted that part of the detent surface 22 may be directly below the closure skirt 8. This configuration minimizes the diameter of the closure 2, yet provides a detent surface 22 of adequate surface area to reliably interfere with the lug 16. With this configuration, the closure 2 may cooperate with a container having a narrow shoulder adjacent its neck and only a small locking lug, as well as with a container having a wider lug.

The closure 2 is preferably formed by injection molding of an elastomeric plastic material such as polyethylene. The flexible bridge 24 not only strengthens the attachment of the pawl 18 during use of the closure, but helps prevent breakage of the pawl 18 during removal of the closure 2 from a mold.

In view of the disclosure, further modifications of the invention will be apparent to those skilled in the art, and it is intended that the scope of the invention be determined solely by the appended claims.

What is claimed is:

1. A closure for cooperation with a container having a threaded annular neck defining a dispensing opening and an upwardly projecting locking lug adjacent the container neck, said closure comprising a circular panel section, an annular skirt depending from the periphery of said panel, threads formed in the interior surface of said skirt for cooperation with the threads on the container neck, a pawl integrally formed on said skirt, said pawl extending radially outwardly from the outside surface of said annular skirt and extending circumferentialy around only a segment of said skirt, the circumferential end of said pawl which faces the direction of rotation for removal of said closure defining a axial detent surface, said pawl and detent surface being constructed and arranged to interfere with the projecting locking lug adjacent the container neck when said closure is fully threadably engaged on the container neck, said pawl being manually deflectable upwardly to permit rotational removal of the closure, and said skirt having a segmental slot formed above said pawl, whereby the manually deflection of said pawl is facilitated.

2. The closure of claim 1 wherein the end of the pawl defining said detent surface is attached to said skirt by an integral, relatively thin, flexible bridge, said bridge defined by said slot and the lower circular edge of said skirt.

3. The closure defined in claim 1 or 2 wherein the circumferential end of said pawl opposite said detent surface tapers radially inwardly to the outside surface of said skirt.

* * * * *

UNITED STATES PATENT AND TRADEMARK OFFICE

CERTIFICATE OF CORRECTION

PATENT NO. : 4,331,247

DATED : May 25, 1982

INVENTOR(S) : George V. Mumford

It is certified that error appears in the above-identified patent and that said Letters Patent are hereby corrected as shown below:

Column 1, line 66, "th" should be -- the --.

Column 2, line 5, "head" should be -- bead --;

line 26, "th" should be -- the --.

Column 3, line 35, "However" should be -- Moreover --;

line 50, "inner" should be -- liner --.

Column 4, line 1, "he" should be -- the --.

Signed and Sealed this

*Third* Day of *August 1982*

[SEAL]

*Attest:*

GERALD J. MOSSINGHOFF

*Attesting Officer*

*Commissioner of Patents and Trademarks*